US009279358B2

(12) United States Patent
Wiegers et al.

(10) Patent No.: US 9,279,358 B2
(45) Date of Patent: Mar. 8, 2016

(54) ACOUSTIC BAFFLE FOR CENTRIFUGAL BLOWERS

(71) Applicant: Textron Innovations Inc., Providence, RI (US)

(72) Inventors: Robert Glynn Wiegers, Wichita, KS (US); Scott Alan Sanborn, Wichita, KS (US)

(73) Assignee: TEXTRON INNOVATIONS, INC., Providence, RI (US)

( * ) Notice: Subject to any disclaimer, the term of this patent is extended or adjusted under 35 U.S.C. 154(b) by 0 days.

(21) Appl. No.: 14/181,330

(22) Filed: Feb. 14, 2014

(65) Prior Publication Data

US 2014/0158463 A1 Jun. 12, 2014

Related U.S. Application Data

(62) Division of application No. 13/436,093, filed on Mar. 30, 2012, now Pat. No. 8,678,131.

(51) Int. Cl.

| | |
|---|---|
| ***F01N 13/00*** | (2010.01) |
| ***F01N 13/18*** | (2010.01) |
| ***F04D 17/04*** | (2006.01) |
| ***F04D 29/42*** | (2006.01) |
| ***F04D 29/66*** | (2006.01) |

(52) U.S. Cl.

CPC ..... *F01N 13/18* (2013.01); *F04D 17/04* (2013.01); *F04D 29/422* (2013.01); *F04D 29/663* (2013.01)

(58) Field of Classification Search

CPC ..... F01N 13/18; F04D 17/04; F04D 29/422; F04D 29/663

USPC ..... 181/224, 225; 415/119

See application file for complete search history.

(56) References Cited

U.S. PATENT DOCUMENTS

| | | | |
|---|---|---|---|
| 2,160,666 | A | 6/1936 | McMahan |
| 2,171,341 | A | 8/1939 | McMahan |
| 3,034,702 | A | 5/1962 | Larsson et al. |
| 3,191,851 | A | 6/1965 | Wood |
| 3,286,914 | A | 11/1966 | Baverstock |
| 3,687,360 | A | 8/1972 | Prew et al. |
| 4,944,654 | A | 7/1990 | Chou et al. |
| 5,536,140 | A | 7/1996 | Wagner et al. |
| 6,039,532 | A | 3/2000 | McConnell |
| 6,041,853 | A | 3/2000 | Edayoshi et al. |
| 6,463,230 | B1 | 10/2002 | Wargo |
| 6,935,835 | B2 | 8/2005 | Della Mora |
| 8,083,477 | B2 | 12/2011 | Hwang et al. |
| 2006/0099071 | A1 | 5/2006 | Kao et al. |
| 2010/0040456 | A1 | 2/2010 | Hwang et al. |

*Primary Examiner* — Jeremy Luks

(74) *Attorney, Agent, or Firm* — Lathrop & Gage LLP

(57) ABSTRACT

An acoustic baffle for reducing noise of a centrifugal fan includes a base for mounting with a fan outlet and a projection extending from the length of the base at a back side of the base and curving away from a top surface of the base. The projection continuously tapers from the base to an apex that aligns with a center line of the base. The projection extends over the fan wheel and tapers from left and right sides of the outlet to a fan tangency point at a midpoint of the outlet and aligned with the apex, when the acoustic baffle is installed in the outlet. The acoustic baffle effects a gradual variation in radial and tangential airflow at the blower outlet, to reduce fan blade passage tone.

11 Claims, 10 Drawing Sheets

ACOUSTIC BAFFLE FOR CENTRIFUGAL BLOWERS

RELATED APPLICATIONS

This application is a divisional of U.S. patent application Ser. No. 13/436,093, filed 30 Mar. 2012.

FIELD

This invention relates to fan blades within evaporator blowers, and to acoustic performance of evaporators in vapor cycle cooling systems.

BACKGROUND

Centrifugal fans are inherently noisy machines, due to the design and airflow interaction of the fan wheel and blower outlet. Air is drawn in at an inlet by a motor-driven rotating impeller. The impeller includes a number of passages arranged in a spiral. Air accelerates through these passages and emerges at an outlet. A cut-off area between the impeller housing and the outlet causes a sudden change of radial and tangential airflow at the outlet. The change in airflow, which is proportional to the blower speed, causes a pressure pulse that results in noise generation.

Conventional efforts to reduce noise generated by centrifugal fans include insulating the fan housing and ducts, both upstream and downstream. Alternately, sound reducing equipment may be installed at the fan inlet or at the fan discharge. For example, U.S. Pat. No. 3,191,851 to Wood describes a two-part system including a square sheet of metal that extends towards and slightly over a small portion of the fan, plus a perforated fairing to decrease size of the fan outlet. U.S. Pat. No. 5,340,275 to Eisinger discloses a rotating cutoff device that is attached within a fan casing. Resonating chambers in the cutoff device are meant to absorb sound. U.S. Pat. No. 6,463,230 to Wargo describes a noise reduction device for smoothing airflow transition at a pinch point of a fan. Wargo focuses on reducing air stagnation at the point where the fan scroll is tangent to the scroll case. The noise reduction device has an airfoil cross section shape, and extends linearly over the fan opening. U.S. Pat. No. 6,575,696 to Lyons et al. combines a sound attenuating cavity, formed as part of the blower housing, with an angled cut off for disrupting pressure fluctuation near the intersection of the exhaust section and the fan scroll.

In another example, U.S. Pat. No. 5,536,140 to Wagner et al. discloses a furnace blower with a flat plate that is inserted parallel to a blower exhaust port. Notches cut in a specified pattern vary the quantity of airflow and reduce pulsing tones. U.S. Pat. No. 5,584,653 to Frank et al. discloses a device for reducing noise in a side channel fan, which appears to include notches or spikes cut into fan outlets and pointing into the intake/discharge, to reduce noise.

U.S. Pat. No. 3,034,702 to Larsson et al. is not concerned with noise suppression, but rather is directed towards a fan having great axial length and dual air inlets, one at each end. Larsson relies upon a series of baffles to provide uniform flow throughout the entire cross-section of the fan discharge opening.

U.S. Pat. No. 6,935,835 to Della Mora discloses various anti-noise stabilizers for centrifugal fans. In particular, Della Mora seeks to homogenize airflow and reduce vortices, in order to reduce noise and improve efficiency of the centrifugal fan. The stabilizers extend for the width of the discharge opening and include dual appendages that face the inlet cone of the fan, one on either side of the discharge opening. U.S. Pat. No. 6,039,532 to McConnell also discloses a device at a fan discharge opening. In particular, McConnell places a baffle in the outlet of a squirrel cage fan. The baffle either tapers continuously from one side of the fan outlet to the other side of the outlet, or is a rectangular insert with a plurality of holes that increase in size from one end to the other end of the baffle.

U.S. Pat. No. 3,687,360 also provides a noise suppressing baffle in a discharge duct. Prew's triangular baffle is inserted within the duct, proximate a chamber housing rotating blades (i.e., a centrifuge chamber). The baffle changes the effective shape of the opening between the duct and the chamber to a trapezoid, and further provides a gradual increase in cross-sectional area of the duct. This change in cross-section decreases velocity of material being discharged into the duct, in order to reduce tendency of the material to build up on walls of the duct.

SUMMARY

In an embodiment, an acoustic baffle for reducing noise of a centrifugal fan includes a base for mounting with a fan outlet. A projection extends from the length of the base at a back side of the base, and curves away from a top surface of the base. The projection continuously tapers from the base to an apex that aligns with a center line of the base. When the acoustic baffle is installed in the outlet, the projection extends over the fan wheel and tapers from left and right sides of the outlet to a fan tangency point at a midpoint of the outlet.

In an embodiment, an acoustic baffle for reducing noise of a centrifugal fan includes a base for mounting with a fan outlet. A projection extends from the length of the base at a back side of the base and curves away from a top surface of the base. The projection includes opposing left and right sides that are parallel to or aligned with left and right sides of the base, and an internal cutout forming a trough. A center point of the trough aligns with a center line of the base. Ends of the left and right sides opposite the base form left and right apices of the internal cutout. Opposing inner sides of the projection defining the cutout continually taper from the trough to the apices. When the acoustic baffle is installed in the outlet, the projection extends over the fan wheel and the left and right sides of the projection continually widen from left and right fan tangency points to the trough.

In an embodiment, an acoustic baffle for reducing noise of a centrifugal fan includes a base for mounting with a fan outlet. A projection extends from the length of the base at a back side of the base and curves away from a top surface of the base. The projection continuously tapers along at least one side, from an area proximate the base to an apex. The apex aligns with a fan tangency point, and the apex or a trough of the projection aligns with a midpoint of the outlet, when the acoustic baffle is installed in the outlet.

DETAILED DESCRIPTION

Figure 1:
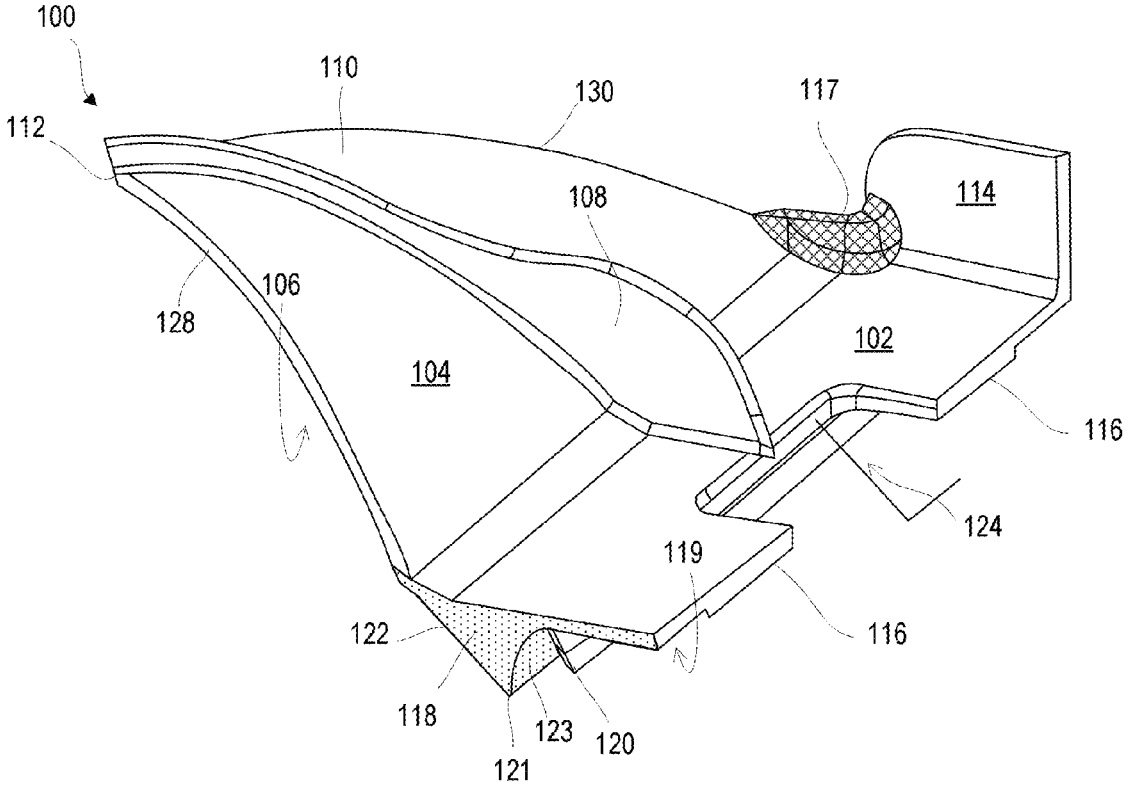
FIG. 1 is a top, perspective view of an acoustic baffle having a linear, spike shape, according to an embodiment.

FIG. 1 shows an acoustic baffle 100 having a base 102 for attaching with the outlet of a blower or fan (hereinafter, fans and blowers are referred to collectively as "a fan" or "the fan"). A spike-shaped extension 104 extends into the fan discharge or blast area and partially over a fan wheel or impeller of the fan, when baffle 100 is secured in the outlet. At least a back side 106 of spike extension 104 (alternately, most or all of spike extension 104) is curved or bent to conform to exterior geometry of the impeller. A fin 108 extends from a front surface 110 of spike extension 104 (and optionally, from base 102 as well) and tapers from base 102 to an apex 112 of extension 104. Fin 108 may be formed with spike extension 104 and/or base 102 (for example, where baffle 100 is molded from plastic or other flowable material), or extension 104 may be formed as a separate part and attached with spike extension 104 and/or base 102. Spike extension 104 and fin 108 effect a gradual change in airflow from the impeller to the outlet, in contrast to the sudden change in radial and tangential airflow typical at the outlet of a centrifugal fan.

At least one sidewall 114 provides an attachment point for bolting or otherwise fastening baffle 100 in the fan outlet. Base 102 may include a terminal lip 116 for extending over a bottom edge or end of the fan outlet, to facilitate positioning of baffle 100 with the outlet. Although not shown, base 102, sidewall 114 and/or lip 116 may form openings for hardware to secure baffle 100 in place. An optional joiner 117 may be included to reinforce or stiffen the junction of sidewall 114 with base 102 and spike extension 104.

A fan case extension 118 may be included on a bottom surface 119 of base 102, for filling a gap between the fan impeller and the fan scroll cut off/blower case. Fan case extension 118 may include a longitudinal ridge 120 for fitting with the fan scroll cut off, to facilitate proper positioning of baffle 100 within the blower outlet. Fan case extension 118 tapers from bottom surface 119 to an end 121, for example forming a roughly triangular shape, although shape of fan case extension 118 may vary depending on geometry of a gap to be filled.

Figure 9:
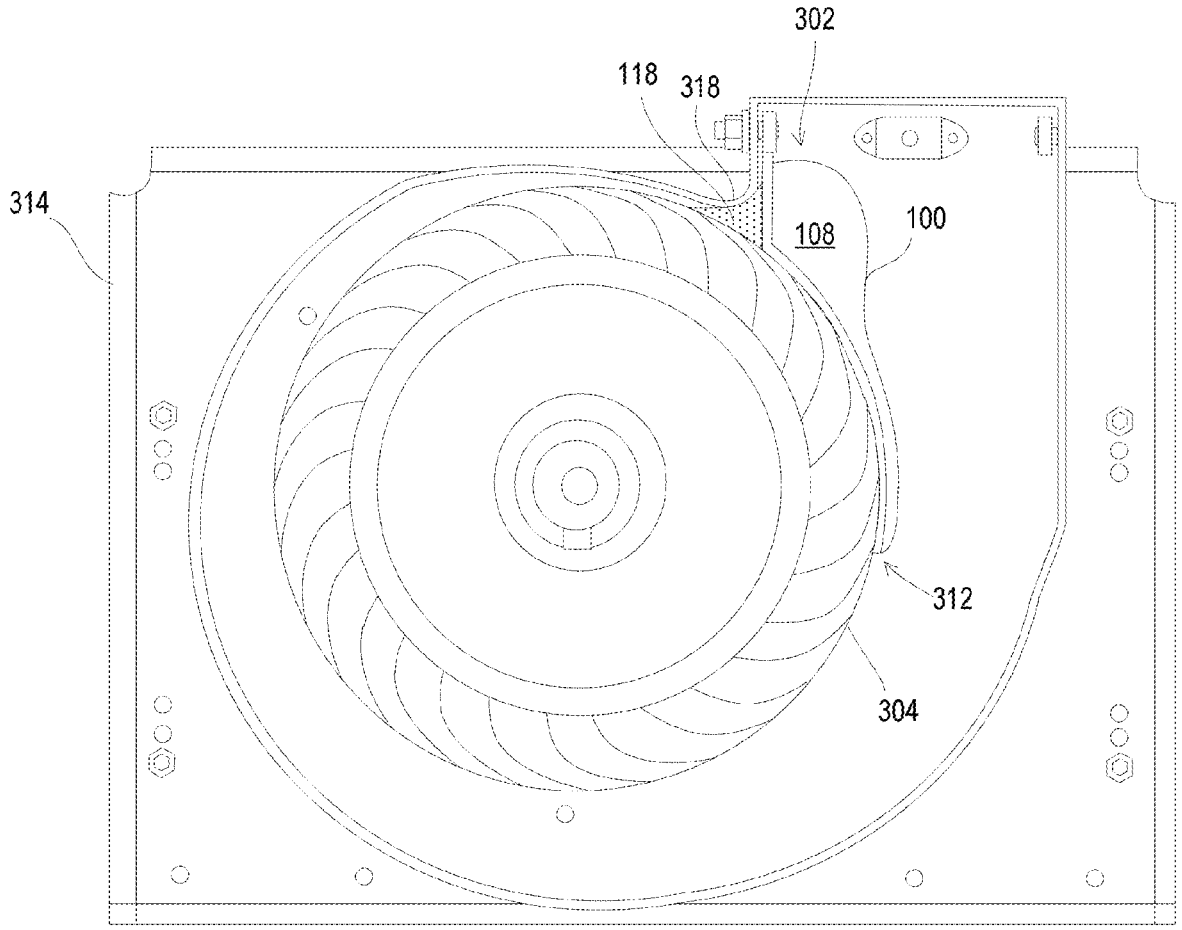
FIG. 9 is a cross-sectional view of the fan and baffle of FIG. 8 with a fan case extension, according to an embodiment.

In one aspect, a back side 122 of fan case extension 118 continues the curvature of back side 106 of spike extension 104. In another aspect, back side 122 essentially forms an obtuse angle with back side 106. When baffle 100 is secured with a fan outlet, fan case extension 118 fills in gaps that could otherwise remain between baffle 100 and the fan scroll cut off, thus enhancing acoustic performance of baffle 100. A front side 123 of fan case extension 118 is curved or otherwise shaped for fitting with a blower case proximate the cut off, as shown in FIG. 9 (described below).

It will be appreciated that geometry of back side 106 and back side 122, as well as length and width of baffle 100 and dimensions of fin 108 may vary depending upon dimensions of the fan to be outfitted with baffle 100. It will also be appreciated that geometry of fan case extension 118 may vary depending upon dimensions of the fan to be outfitted with baffle 100. For example, an angle between back side 106 and back side 122 may be determined based upon dimensions of an existing fan case, such that apex 112 is a minimal distance from the fan scroll without interfering with the fan scroll during service or use. Base 102 may also include a cutout 124, dimensions and placement of which may also vary to accommodate preexisting features of the fan outlet.

Figure 2:
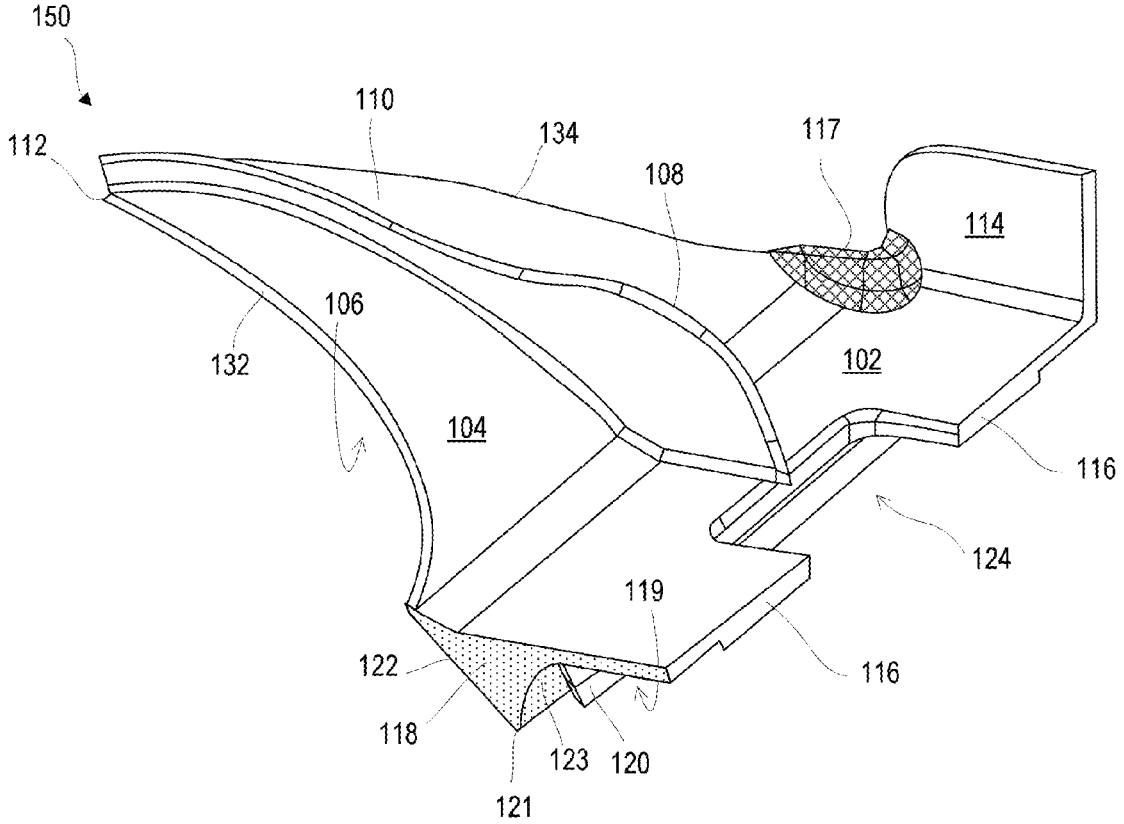
FIG. 2 is a top perspective view of an acoustic baffle shaped as a non-linear spike, according to an embodiment.

Left and right sides 128 and 130 of spike extension 104 may taper from base 102 to apex 112 in a linear manner, as shown in FIG. 1, or sides 128 and 130 may feature a non-linear taper from base 102 to apex 112, as shown with respect to baffle 150, FIG. 2.

FIG. 2 shows an acoustic baffle 150, which is similar to baffle 100. Where baffle 100 has linearly tapering sides 128 and 130, baffle 150 includes non-linearly tapering left and right sides 132, 134. That is, sides 132 and 134 taper from base 102 to apex 112 in a non-linear manner. Identical features of baffles 100 and 150 are noted using the same reference numbers.

Figure 3:
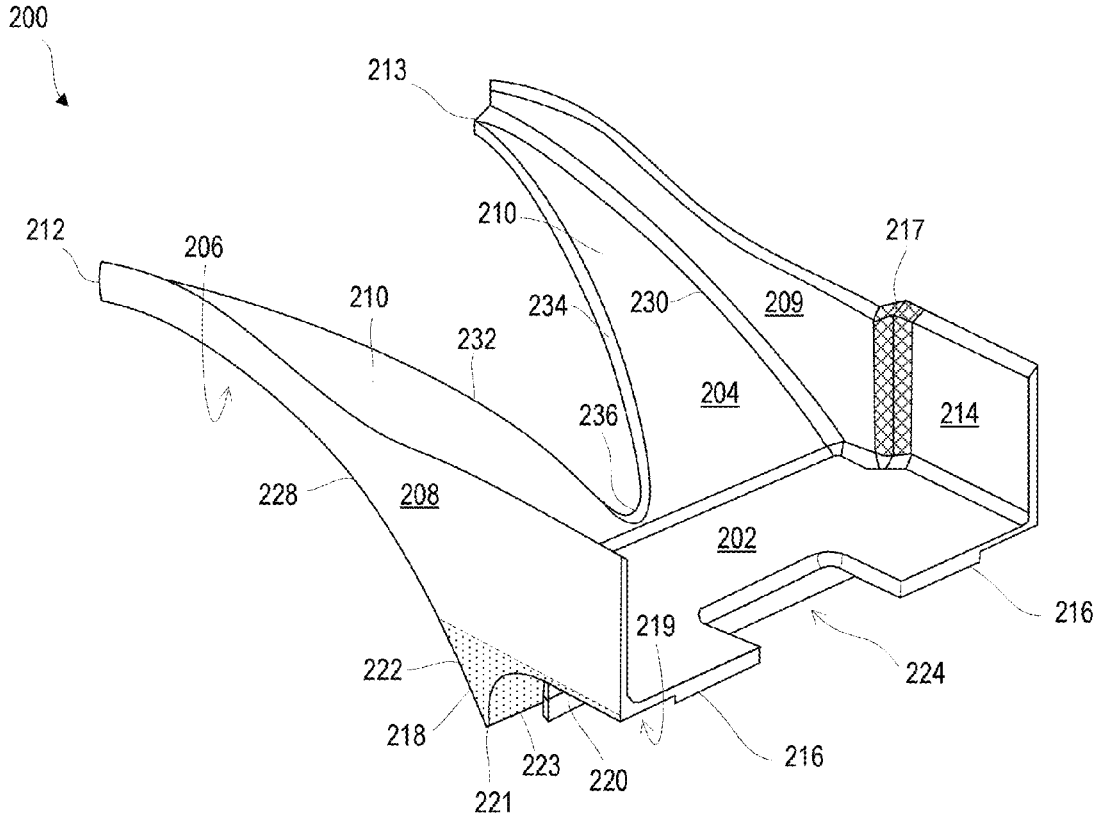
FIG. 3 is a top perspective view of an acoustic baffle shaped having a linear, vee shape, according to an embodiment.
Figure 4:
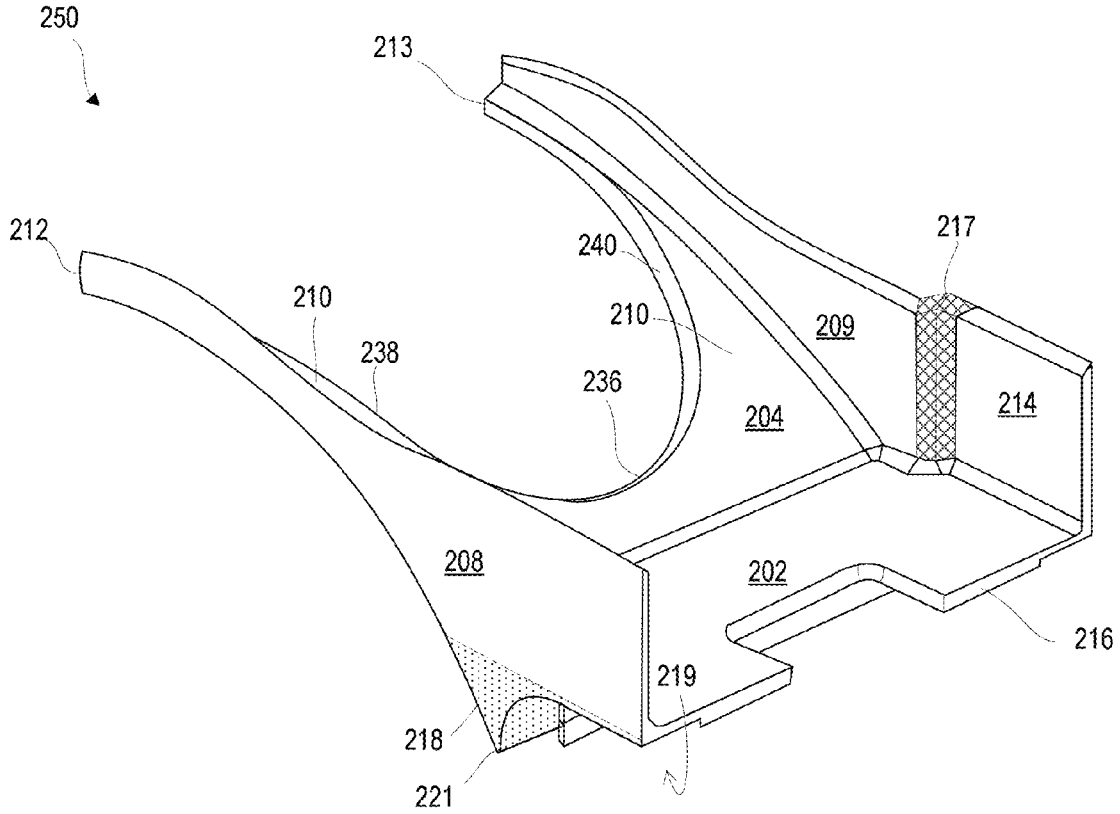
FIG. 4 is a top perspective view of an acoustic baffle shaped as a non-linear vee, according to an embodiment.

FIGS. 3 and 4 show acoustic baffles 200 and 250, respectively. Baffles 200 and 250 share multiple identical features, which are denoted with the same reference numbers from one drawing to the other. Baffles 200 and 250 each have a base 202, which is similar to base 102, described above. A v-shaped ("vee" shaped) extension 204 extends from base 202 and shaped to conform to exterior geometry of a fan impeller when baffle 200/250 is secured in the fan outlet. In particular, at least a back side 206 of vee extension 204 is curved or bent to conform to exterior curvature of the impeller. Left and right fins 208, 209 extend from left and right sides 228 and 230 of vee extension 204, forming sidewalls of extension 204. Hereafter, fins 208 and 209 may be referred to as sidewalls 208 and 209.

Fins/sidewalls 208 and 209 taper in height from base 202 to opposing left and right apices 212 and 213 of vee extension 204. Sidewalls 208 and 209 may be formed with vee extension 204, for example where baffle 200/250 is molded from plastic or other flowable material), or sidewalls 208 and 209 may be formed as separate parts and attached with vee extension 204 and/or base 202. The junction of sidewall 208 or 209 with base 202 and a respective sidewall 214 of base 202 may be reinforced or stiffened with an additional joiner 217. In one aspect, sidewall 214 and sidewall 208 or 209 form a continuous sidewall, for example where baffle 200/250 is formed as a unitary piece. Joiner(s) 217 may be added if stiffening or reinforcement is desired. Like spike extension 104 and fin 108 (FIGS. 1 and 2), vee extension 204 and sidewalls 208 and 209 effect a gradual change in airflow from the impeller to the outlet.

Sidewall(s) 214 extend from base 202 and provide an attachment point for bolting or otherwise fastening baffle 200/250 in the fan outlet. Base 202 may also include a terminal lip 216 for extending over a bottom edge or end of the fan outlet, to facilitate positioning of baffle 200 with the outlet. Although not shown, base 202, sidewall 214, one or both of sidewalls 208 and 209 and/or lip 216 may form openings for hardware to secure baffle 200/250 in place.

A fan case extension 218 extends from a bottom surface 219 of base 202, for filling a gap between the fan impeller and the fan scroll cut off/blower case, when baffle 200/250 is installed in a centrifugal fan. Fan case extension 218 may include a longitudinal ridge 220 for fitting with the fan scroll cut off, to facilitate positioning of baffle 100 within the blower outlet. Fan case extension 218 tapers from bottom surface 219 to an end 221, for example forming a roughly triangular shape, although shape of fan case extension 218 may vary depending on geometry of a gap to be filled.

In one aspect, a back side 222 of fan case extension 218 continues curvature of back side 206 of vee extension 204. In another aspect, back side 222 essentially forms an obtuse angle with back side 206. When baffle 200/250 is secured with a fan outlet, fan case extension 218 fills a gap that could otherwise remain between baffle 200/250 and the fan scroll cut off, thus enhancing acoustic performance. A front side 223 of fan case extension 218 is curved or otherwise shaped for fitting with a blower case proximate the cut off (see, e.g., baffle 150 in housing 314, FIG. 9).

It will be appreciated that geometry of back side 206 and back side 222, as well as length and width of baffle 200/250 and dimensions of sidewalls 208 and 209 may vary depending upon dimensions of the fan to be outfitted with baffle 200/250. It will also be appreciated that geometry of fan case extension 218 may vary depending upon dimensions of the fan to be outfitted with baffle 200/250. For example, an angle between back side 206 and back side 222 may be determined based upon dimensions of an existing fan case, such that left and right apices 212, 213 are a minimal distance from the fan scroll without interfering with the fan scroll during service or use. Base 202 may also include a cutout 224, dimensions and placement of which may also vary to accommodate preexisting features of the fan outlet.

Vee extension 204 of baffle 200 (FIG. 3) has inner, left and right sides 232 and 234 that taper from apices 212 and 213 (respectively) to a trough 236 in a linear manner Vee extension 204 may alternately feature a non-linear taper of its opposing internal sides. Baffle 250, FIG. 4 includes inner left and right sides 236 and 238, which taper from apices 212 and 213 to base 202 in a non-linear manner.

Baffles 100, 150, 200 and 250 may be made of any material or materials that are compatible with the fan to be outfitted. In one aspect, baffles 100-250 are made of plastic, such as a thermoformed plastic. Fan case extensions 118, 218 may be integral to baffles 100, 150 and 200, 250, respectively, or fan case extensions 118, 218 may be formed of the same or another material and attached with their respective acoustic baffles.

Figure 5:
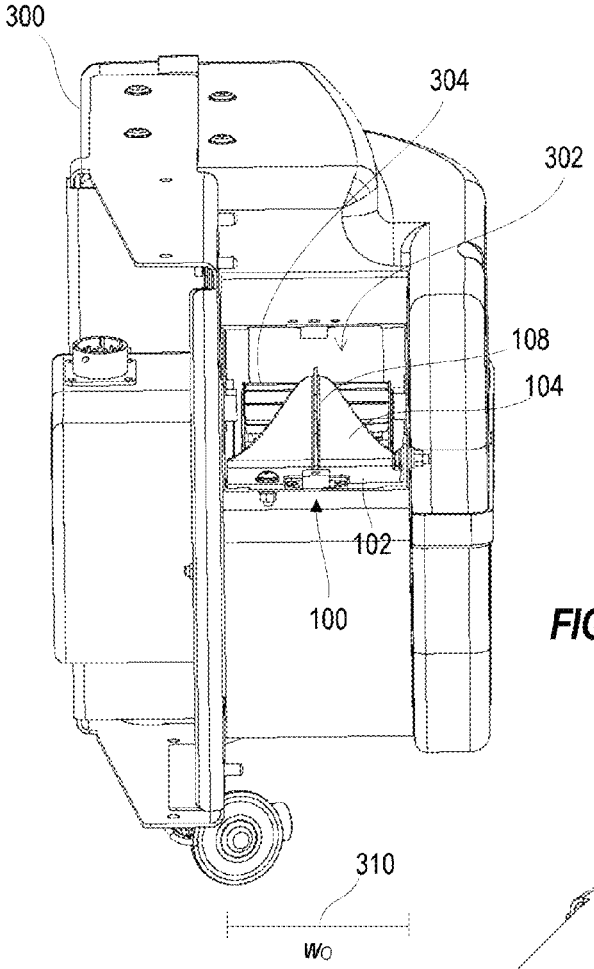
FIG. 5 is a front view of a centrifugal fan with the baffle of FIG. 2 installed proximate the blower outlet, according to an embodiment.
Figure 6:
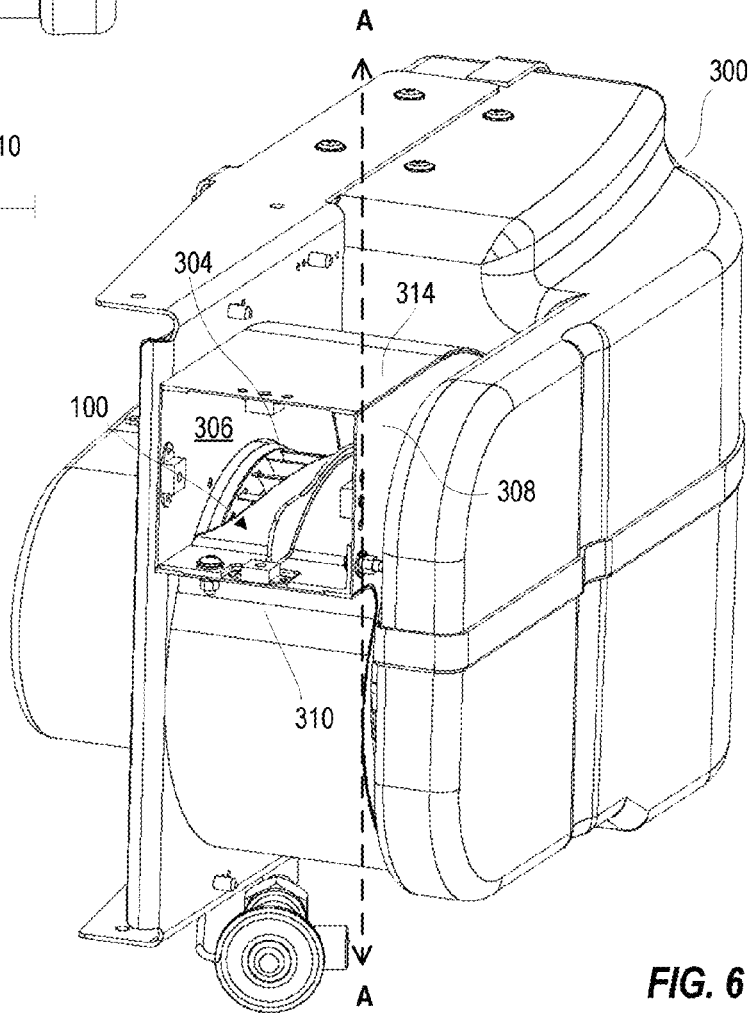
FIG. 6 is a perspective view of the fan and installed baffle of FIG. 2.

FIGS. 5 and 6 show a centrifugal fan 300 with baffle 150 (with a non-linear spike extension 104, as shown in FIG. 2) installed in an outlet 302. FIGS. 5 and 6 are best viewed together with the following description.

Base 102 of baffle 150 is sized to span a width $w_O$ of the outlet, for example fitting over or with a cut off of fan 300 (shown in FIGS. 7-9) via features 118-120. Extension 104 extends over and conforms to curvature of an impeller 304 of fan 300 (at least along back side 106). When baffle 150 is in place, extension 104 tapers over impeller 304 from opposing sides 306 and 308 of outlet 302 to a midpoint 310 of outlet 302 (i.e., a point halfway between sides 306 and 308, shown marked as a half point of width $w_O$). Apex 112 overlies (but does not touch) impeller 304 proximate a fan tangency point 312 (see FIGS. 8 and 9). Fin 108 of extension 104 tapers from base 102, proximate the fan cut off, to apex 112 proximate tangency point 312. Thus, baffle 150 smoothes changes in both radial and tangential airflow at outlet 302 to reduce fan noise (known as the fan blade passage tone).

Figure 7:
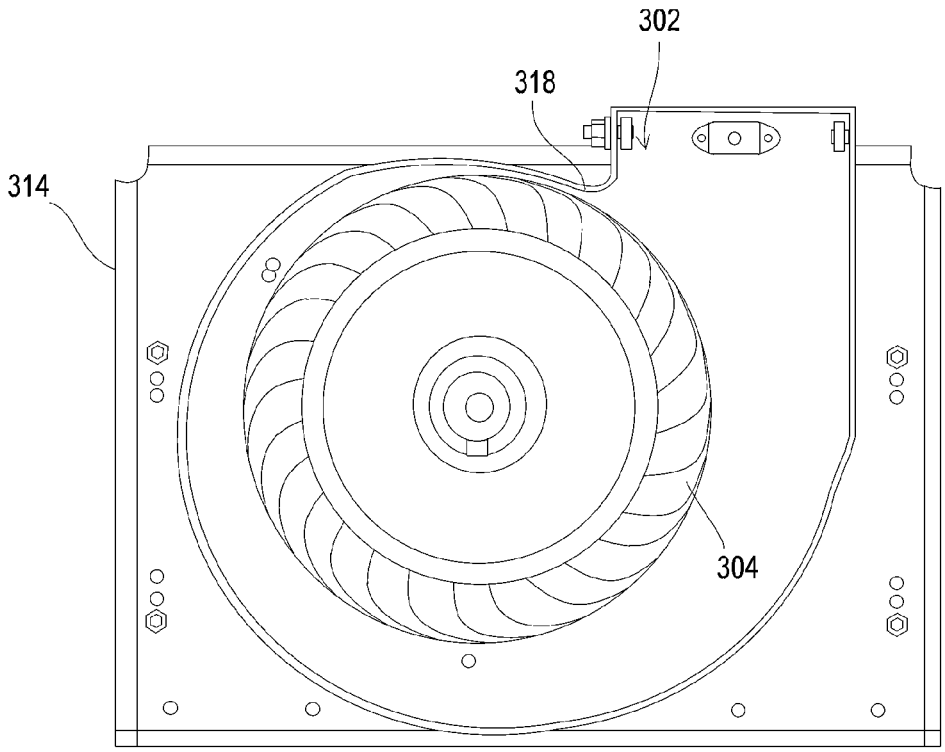
FIG. 7 is a cross-sectional view of a prior art centrifugal fan.
Figure 8:
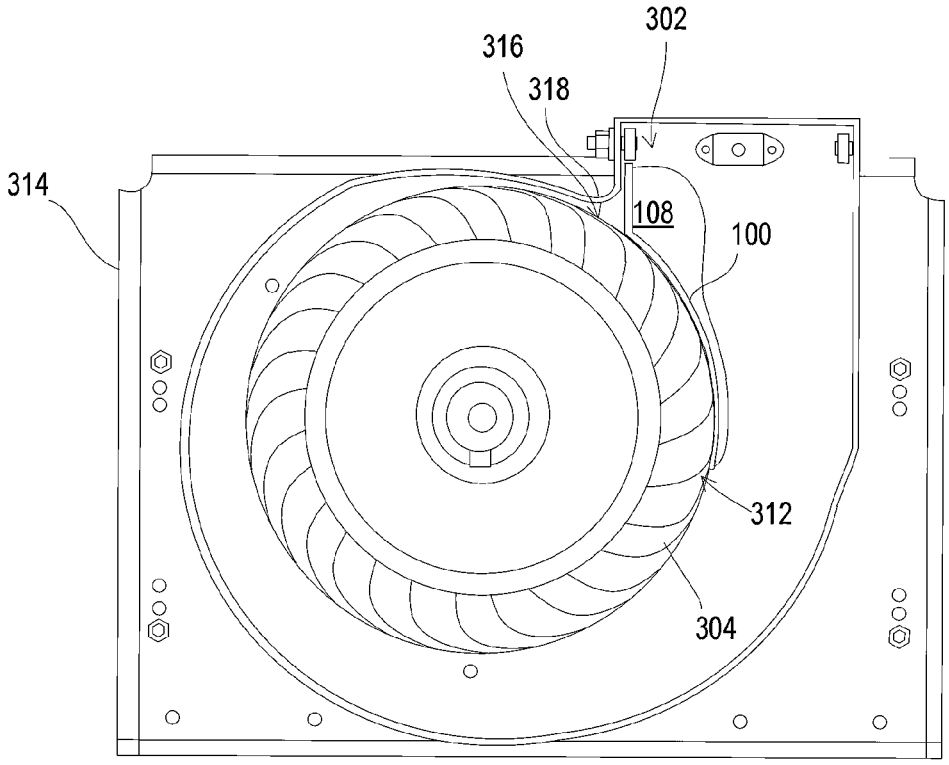
FIG. 8 is a cross-sectional view of the fan of FIG. 7 showing an installed acoustic baffle that lacks a fan case extension, according to an embodiment.

FIGS. 7-9 are cross-sectional views of a fan scroll/housing 314, taken along line A-A (see FIG. 6). FIG. 7 shows outlet 302 without an acoustic baffle. FIG. 8 shows outlet 302 fitted with baffle 150, with fan case extension 118 removed for purposes of viewing a gap at the fan scroll cut off. FIG. 9 shows outlet 302 fitted with baffle 150 and showing fan case extension 118. It will be appreciated that although baffle 150 is shown and described with respect to fan 300/housing 314, baffles 100, 200 or 250 may also fit with fan outlet 302 to provide noise reduction as described herein.

FIGS. 7-9 are best viewed together with the following description. Note the relatively large gap between impeller 304 and fan scroll cut off 318 in FIG. 7, whereas, in FIG. 8, the gap is reduced by baffle 150. Baffle 150 extends out over impeller 304 to fan tangency point 312 and gradually varies the flow area of outlet 302 after tangency point 312 (for example, via tapering left and right sides 128 and 130, and via tapering fin 108). However, in FIG. 8, a reduced gap 316 between baffle 150 and a fan scroll cut off 318 remains unfilled.

In FIG. 9, baffle 150 includes fan case extension 118, which fills gap 316. Baffle 150 and fan case extension 118 together encase impeller 304. In laboratory tests, filling gap 316 improved acoustic performance of baffle 150 by up to about 50%. As shown, fan case extension 118 is somewhat triangular in cross section; however, shape of fan case extension 118/218 may vary according to a gap to be filled.

Fan blade passage tone (objectionable fan noise) is dependent upon the quantity of fan blades in the fan impeller, and the speed of the fan. The fan blade passage frequency, which generates the objectionable noise, can be calculated as follows:

$$Frequency_{Fan}(\text{Hz}) = \frac{RPM_{Fan}}{60} \quad \text{Eq. 1}$$

$$Frequency_{FanBladePassage}(\text{Hz}) = Frequency_{Fan} \times FanBladeQuantity \quad \text{Eq. 2}$$

Once the fan blade passage frequency is known, it may be isolated during acoustic surveys of the fan, and overall effectiveness of an acoustic baffle may be measured.

Figure 10:
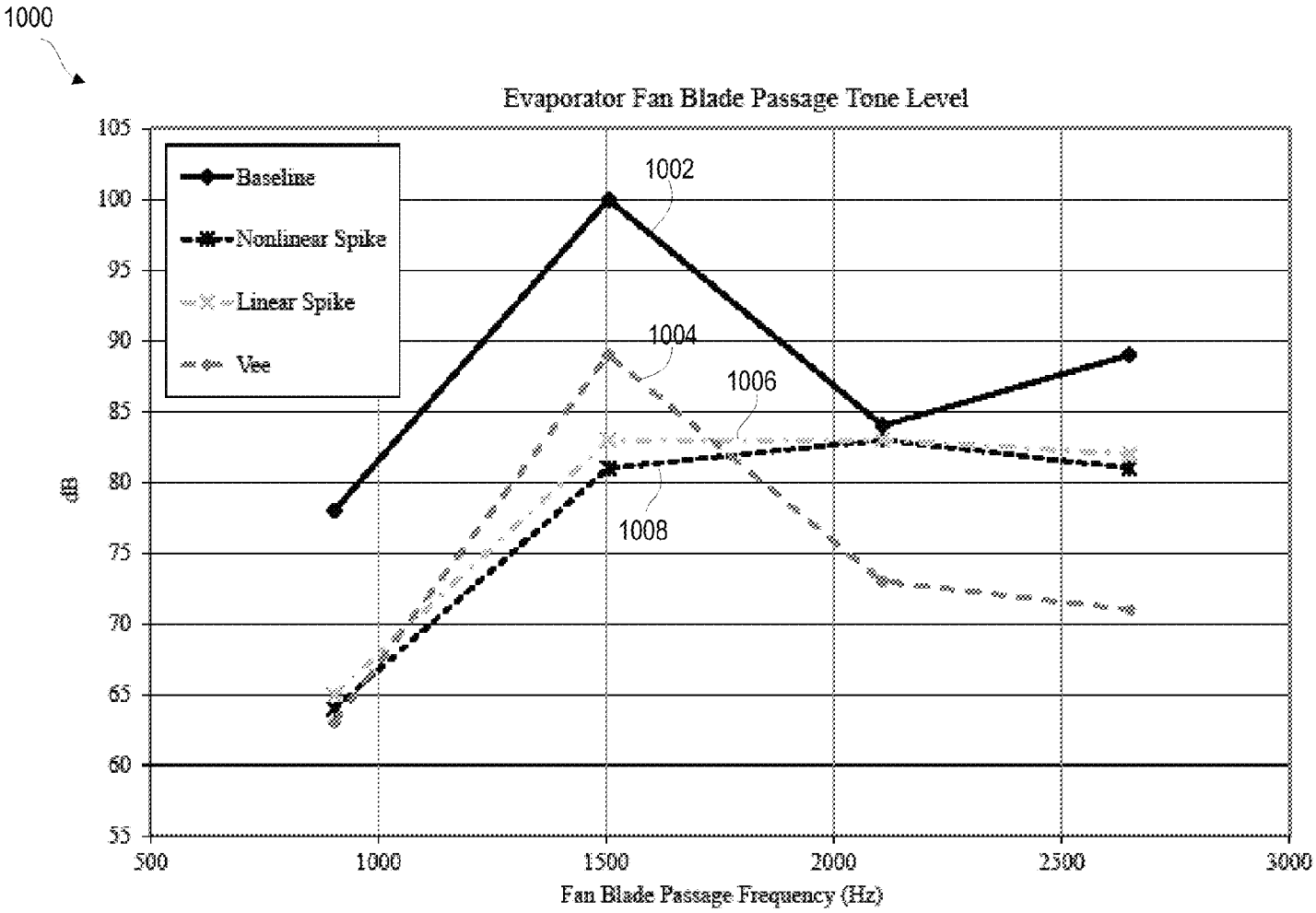
FIG. 10 is a graph showing exemplary reduction of fan blade passage tones by the baffles of FIGS. 1-4.

FIGS. 10-14 are graphs showing experimental results obtained in testing acoustic baffles 100 and 200. Turning first to FIG. 10, graph 1000 plots evaporator fan blade passage tone (dB) against fan blade passage frequency (Hz). Line 1002 shows baseline fan blade passage tone of a fan without an acoustic baffle, at frequencies from about 900 Hz to about 2,550 Hz. Line 1004 illustrates fan blade passage tone of a fan outfitted with baffle 200 or 250 at these same frequencies. Line 1006 illustrates fan blade passage tone of a fan outfitted with linear tapered baffle 100, again at frequencies between about 900 Hz and about 2,550 Hz. Line 1008 shows, at these frequencies, fan blade passage tone of a fan outfitted with non-linear tapered baffle 150.

As shown, at 1500 Hz, a non-baffled fan produced a fan blade passage tone of about 100 dB. In contrast, a fan outfitted with baffle 200/250 produced about 89 dB of noise. A fan outfitted with baffle 100 produced about 83 dB fan blade passage tone, and a fan outfitted with baffle 150 produced about 81 dB.

Figure 11:
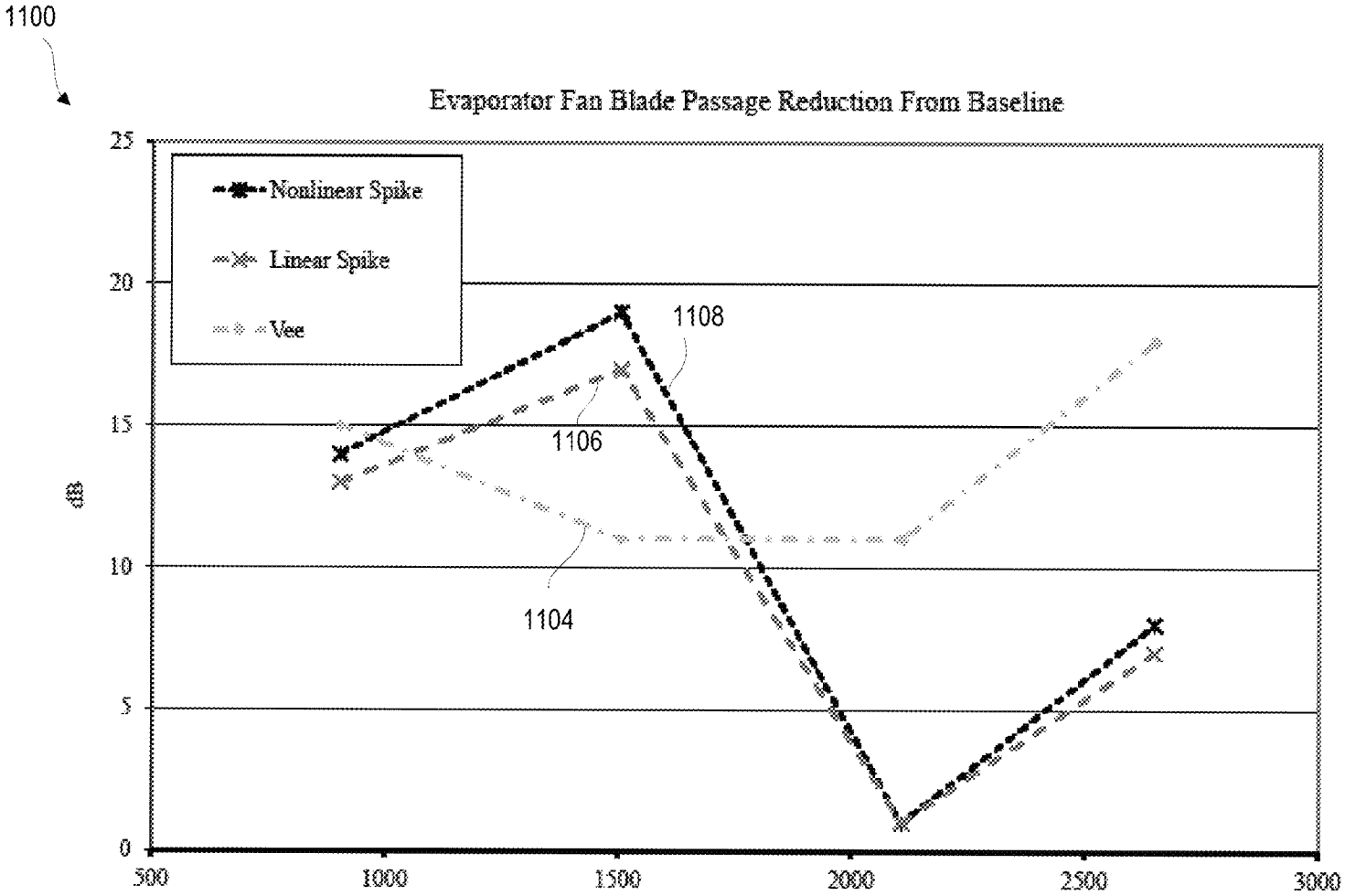
FIG. 11 is a graph similar to that of FIG. 10, but illustrating level of tone reduction by the baffles of FIGS. 1-4 from a baseline level.

FIG. 11 features a graph 1100 showing reduction of fan blade passage frequency from baseline 1002 (FIG. 10). Line 1104 shows reduction by baffle 200/250, line 1106 shows reduction by baffle 100, and line 1108 shows reduction by baffle 150. At 1500 Hz, baffle 200/250 reduced fan blade passage tone by about 11 dB. Baffle 100 reduced tone by about 17 dB, and baffle 150 reduced fan blade passage tone by about 19 dB. At about 2,100 Hz, baffles 100/150 achieved about a 1 dB reduction in fan blade passage tone, whereas baffles 200/250 reduced tone by about 11 dB.

Figure 12:
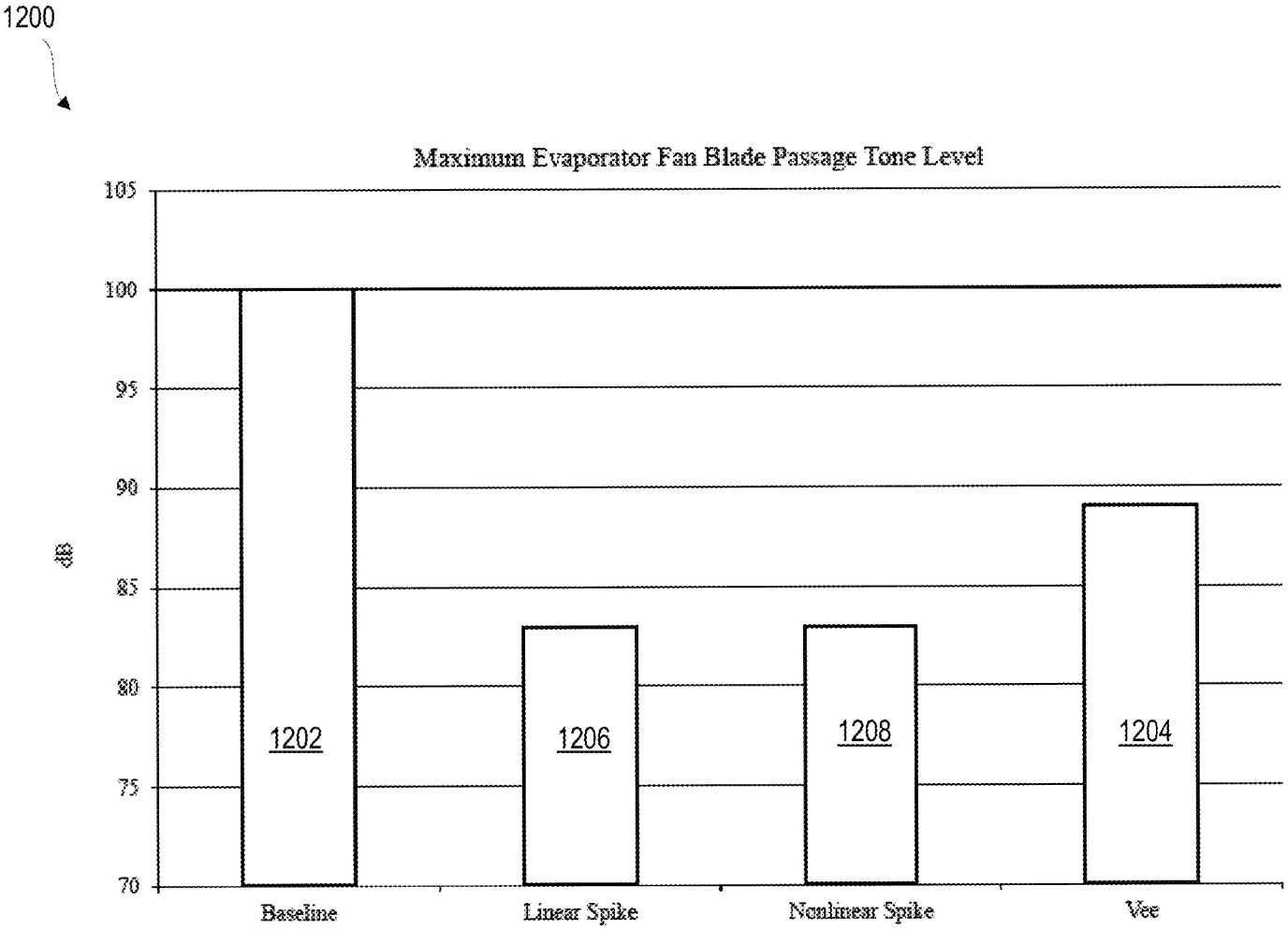
FIG. 12 is an exemplary bar graph comparing maximum fan blade passage tone levels achieved with the baffles of FIGS. 1-4 with a baseline level.

FIG. 12 shows a bar graph 1200 illustrating maximum evaporator fan blade passage tone level over a fan speed sweep of 600-5,700 RPM. Over this range, the maximum baseline (baffle-free fan) passage tone level was 100 dB. Bar 1202 represents the baseline. At this tone, baffles 100 and 150, represented by bars 1206 and 1208, respectively, reduced noise by about 17 dB. Baffles 200 and 250, represented by bar 1204 achieved about an 11 dB reduction.

Experimental results suggest that overall, "spike" style acoustic baffles such as baffles 100 and 150 have better noise reduction in the 1,200-1,700 Hz fan blade passage frequency, while "vee" style baffles 200 and 250 have better noise reduction in the 2,100-2,600 Hz fan blade passage frequency.

Figure 13:
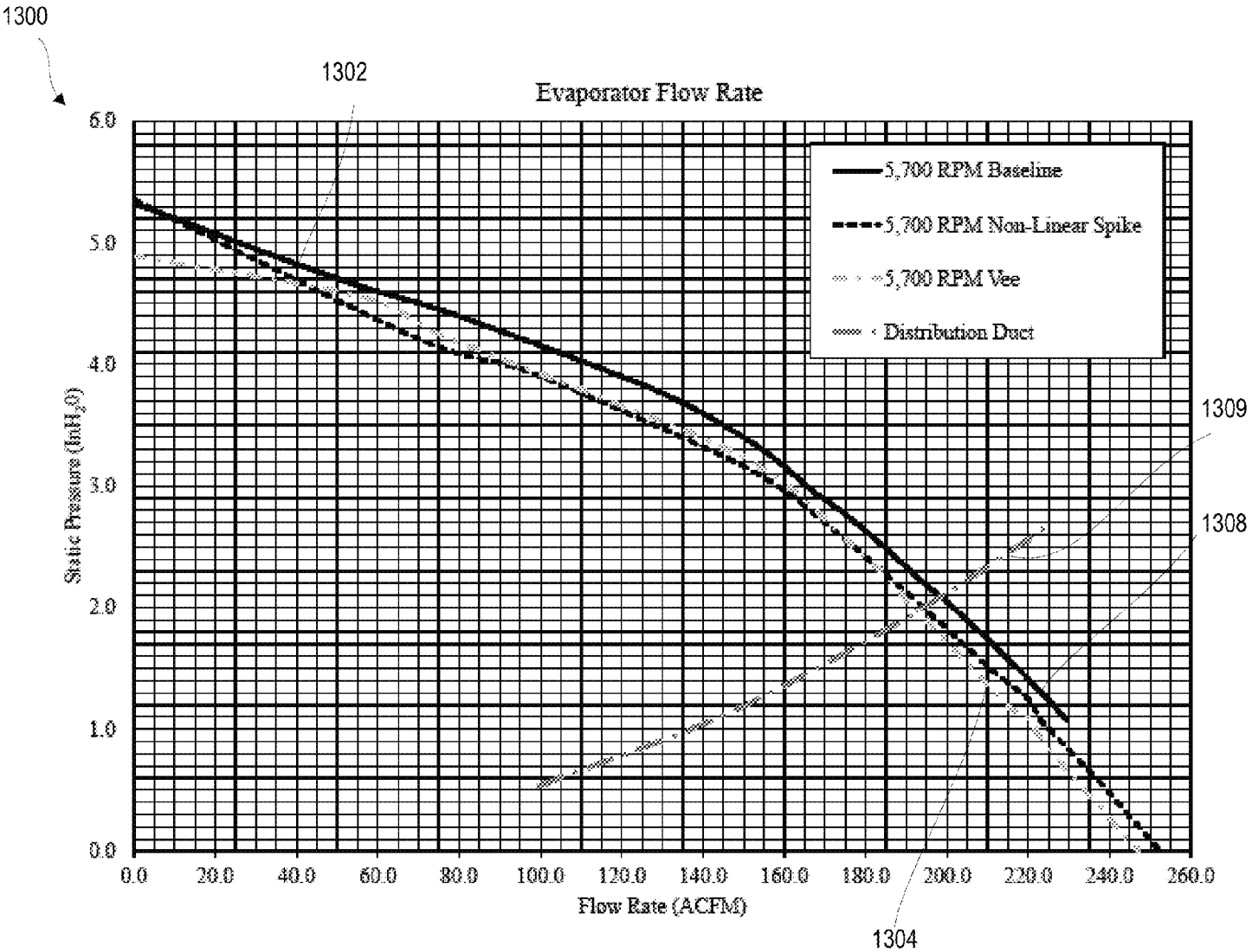
FIG. 13 is a graph comparing static pressure with evaporator flow rate, and illustrating performance of the baffles of FIGS. 2-4 as compared to baseline and distribution duct flow.
Figure 14:
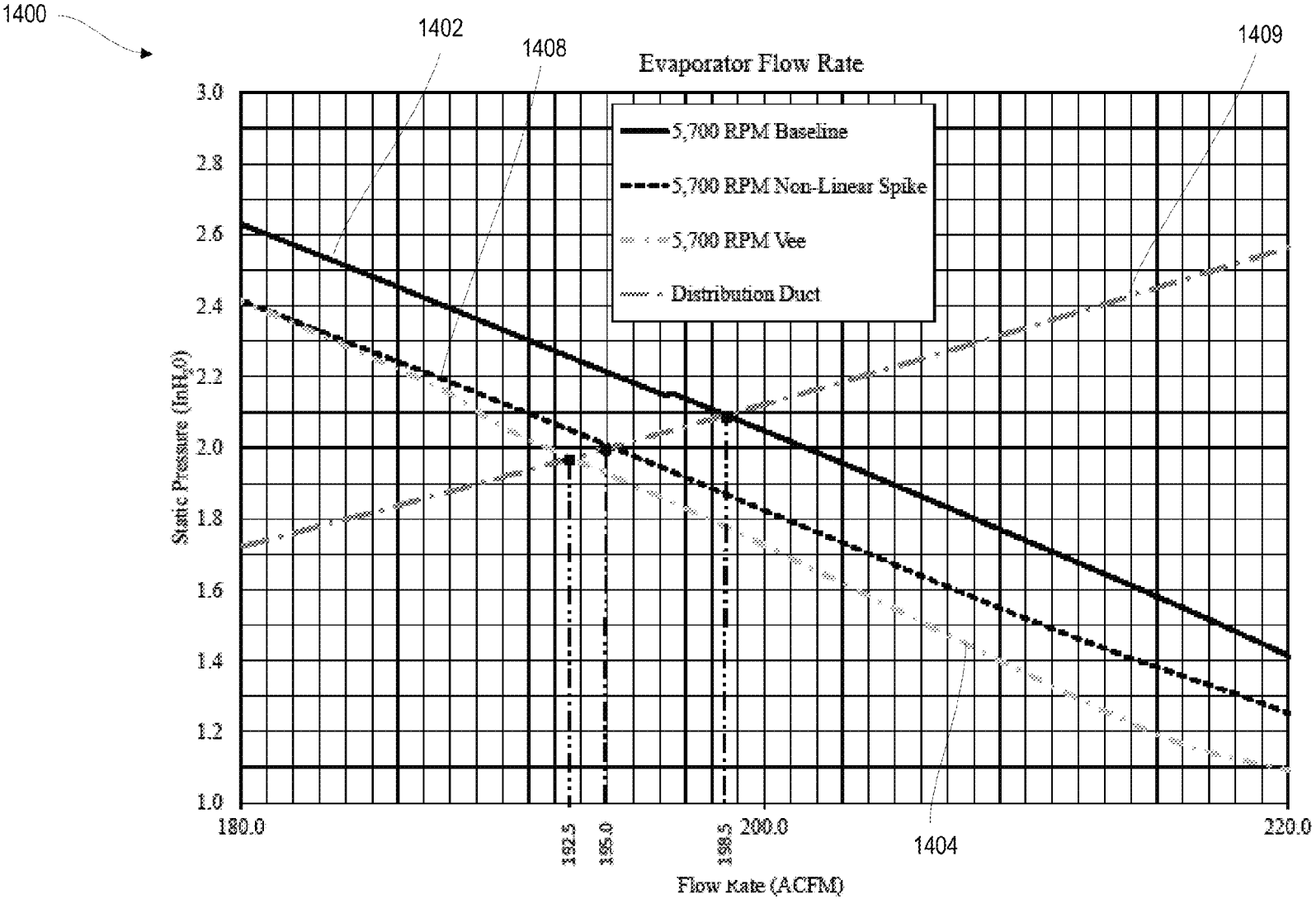
FIG. 14 is a partial view of the graph of FIG. 13, further illustrating impact of the baffles of FIGS. 2-4 on evaporator flow rate.

Inclusion of baffle 100, 150, 200 or 250 in the blower outlet of a centrifugal fan (i.e., outlet 302 of fan 300) results in minimal reduction of flow into the distribution duct (e.g., a duct attached at outlet 302). Impact on blower flow rate was calculated by measuring the static pressure at multiple flow rates for a baseline configuration, and with the acoustic baffles installed. FIG. 13 shows a graph 1300 that plots static pressure ($InH_2O$) against flow rate (ACFM). Line 1302 is a baseline depicting flow rate of a baffle free fan. Line 1304 shows flow rate of a fan outfitted with vee-style baffle 200 or 250. Line 1308 illustrates flow rate of a fan outfitted with baffle 150. Line 1309 illustrates flow within a distribution duct of the fan. Data collected from fans outfitted with acoustic baffles 150 or 200/250 (lines 1308 and 1304) was compared with the distribution duct performance (line 1309) and flow losses calculated. FIG. 14 is a graph 1400 that shows losses using baffle 150 and baffle 200/250. Line 1402 represents a 5,700 RPM baseline, while line 1404 represents a fan with baffle 200/250 and line 1408 represents the fan with baffle 150 installed. Line 1409 shows flow within the distribution duct. With baffle 150 installed, a 4.5 cfm loss was measured at 5,700 RPM. A 6.0 cfm loss in flow at 5,700 RPM was measured with baffle 200/250 in place. These losses amount to a 2.27% reduction in flow with baffle 150, and a 3.02% reduction with baffle 200/250. The measured losses minimally impact performance of the centrifugal fan, and are well outweighed by gains in acoustic performance (see FIGS. 10-12).

Certain changes may be made in the above systems and methods without departing from the scope hereof. For example, features and use shown or described with respect to one of baffles 100-250 may be incorporated into or pertain to another of baffles 100-250. Thus, it is intended that all matter contained in the above description or shown in the accompanying drawings be interpreted as illustrative and not in a limiting sense. It is also to be understood that the following claims are to cover generic and specific features described herein, and all statements of the scope of the invention which, as a matter of language, might be said to fall there between.

What is claimed is:

1. An acoustic baffle for reducing noise of a centrifugal flan, comprising:

a base for mounting with a fan outlet;

a projection extending from the length of the base at a back side of the base and curving away from a top surface of the base, the projection continuously tapering from the base to an apex that aligns with a center line of the base;

wherein the projection significantly extends outwardly from, and over the centrifugal fan, and conforms to an outer curvature of the centrifugal fan and tapers from left and right sides of the outlet to a fan tangency point substantially at a midpoint of the outlet and aligned with the apex, when the acoustic baffle is installed in the outlet.

2. The acoustic baffle of claim 1, further comprising a fin extending perpendicularly from a top surface of the projection and from the top surface of the base.

3. The acoustic baffle of claim 2, the fin tapering from the base to the apex of the projection.

4. The acoustic baffle of claim 1, the projection tapering linearly or non-linearly from the base to the apex, to form a linear or non-linear spike.

5. The acoustic baffle of claim 2, the projection and the fin effecting a gradual variation of flow area from the fan tangency point to a discharge of the fan.

6. The acoustic baffle of claim 1, the baffle effecting a gradual transition in radial and tangential airflow at the fan outlet.

7. The acoustic baffle of claim 1, a bottom surface of the base further comprising a fan case extension extending from the length of the bottom surface; the fan case extension filling a gap between the base and a cut off of the fan, when the baffle is installed in the outlet.

8. The acoustic baffle of claim 7, the fan case extension comprising a longitudinal ridge configured for fitting about a cut off of the fan, to facilitate positioning of the acoustic baffle in the fan outlet.

9. The acoustic baffle of claim 1, further comprising a sidewall extending from an end to the base and subsequently normal to the top surface of the base, for fitting against the left or right side of the outlet.

10. The acoustic baffle of claim 9, the sidewall forming at least one attachment point or aperture for bolting the acoustic baffle in the outlet.

11. The acoustic baffle of claim 1, the base forming a front terminal lip for extending over a bottom edge or end of the fan outlet, to facilitate positioning of the acoustic baffle in the outlet.

* * * * *